United States Patent [19]

Wolf et al.

[11] Patent Number: 4,505,598

[45] Date of Patent: Mar. 19, 1985

[54] CASE FOR A CLOCK

[75] Inventors: Dieter Wolf, Hattersheim; Joachim Müller, Offenbach, both of Fed. Rep. of Germany

[73] Assignee: VDO Adolf Schindling AG, Frankfurt am Main, Fed. Rep. of Germany

[21] Appl. No.: 386,172

[22] Filed: Jun. 8, 1982

[30] Foreign Application Priority Data

Nov. 26, 1981 [DE] Fed. Rep. of Germany ..... 3146897

[51] Int. Cl.[3] ..... G04B 37/00

[52] U.S. Cl. ..... 368/309; 368/291; 368/318

[58] Field of Search ..... D10/1, 17, 18; 248/114; 361/383, 384, 379, 381; 206/305, 301, 18; 73/431; 356/319; 368/309, 316, 318, 322, 276, 294, 291, 10

[56] References Cited

U.S. PATENT DOCUMENTS

| | | | |
|---|---|---|---|
| 1,537,228 | 5/1925 | Gargan | 361/383 |
| 3,376,845 | 4/1968 | Rebollido | 356/319 X |
| 3,407,869 | 10/1968 | Staunton | 361/383 X |
| 3,461,663 | 8/1969 | Albinger, Jr. et al. | 368/309 X |
| 3,582,659 | 6/1971 | Dekker | 356/319 X |
| 3,681,663 | 8/1972 | Albers | 361/379 |
| 3,702,736 | 11/1972 | Coggeshall | 356/319 |
| 3,837,160 | 9/1974 | Hettich | 368/316 |
| 4,282,591 | 8/1981 | Andreuccetti | 368/10 |
| 4,322,835 | 3/1982 | Ernst et al. | 368/316 X |

*Primary Examiner*—Ulysses Weldon

*Attorney, Agent, or Firm*—Martin A. Farber

[57] ABSTRACT

A case or housing for a clock, particularly for use in moist rooms, has a cup-shaped dome portion with an opening that is closed by a cover glass at the side of the observer and while a rear portion is closed by a back cover. A support plate which is provided in the dome portion divides the case into several inner spaces and bears a clock movement that can include a dial. In order for the case to be suitable for moist rooms, such as bathrooms, communicating with the case inner space which is adjacent the interior face of the cover glass are air circulation passages which communicate with the outside.

19 Claims, 17 Drawing Figures

CASE FOR A CLOCK

The present invention relates to a case for a clock, particularly a clock for moist rooms. The case has a cup-shaped dome portion which opens towards the side of the observer, and is closed by a cover glass, while its rear portion is closed by a back cover. The case also has a support plate fastened in the dome portion which divides the case into a plurality of inner spaces. The support plate bears a clock movement that can include a dial.

In such clock cases it is known to tightly enclose the case in order to prevent moisture from entering. Moisture proof cases are very expensive. If the enclosure is not perfectly tight, moist air can penetrate to the inside of the case and precipitate therein. Since the moisture does not emerge from the case, large amounts of moisture can accumulate therein after a certain amount of time.

The object of the present invention is to provide a case for a clock of the above-mentioned type which is suitable for use in moist rooms such as bathrooms.

This object is achieved in accordance with the invention in the manner whereby an inner space of the case is adjacent the interior face of the transparent cover glass and there are adjacent air circulation passages which lead to the outside. These air circulation passages or openings enable a stream of air flowing through the inner space of the case to draw away any moisture which has entered the case. The accumulation of condensate is thus not possible. The possibility of mist depositing on the interior face of the cover glass so that the clock cannot be read by an observer is also avoided.

The air circulation passages can be provided in the dome portion and/or in the cover glass and are advantageously distributed on the case. Openings may also be provided in the back cover. In this manner, all parts of the inner spaces of the case communicate with the stream of air which flows through the air circulation openings.

The air circulation openings can emerge towards the outside, both radially and axially.

One advantageous arrangement of the air circulation passages which an observer would not find distracting resides in locating them between the cover glass and the dome portion.

If openings also extend to the outside between the back cover and the dome portion, it is advantageous to have them emerge to the outside in a plane which is parallel to the plane of the outermost rear contour of the case. In this manner the air circulation openings are always obstructed and cannot be covered since the clock is arranged as a wall clock with its back side against a wall. This same problem would also arise if the clock were arranged as a standing clock with its rear side against a wall. One simple solution in this connection is for the back cover to protrude with respect to the dome portion towards the rear of the case.

The back cover may have an extension which protrudes from its plane and extends into the dome portion enabling the extension to be fastened within the dome portion by, for example, attachment elements of the back cover. In order to avoid too great a weight, the extension is preferably cup-shaped and open towards the inside of the dome portion.

The extension can have its dome-side end surface resting against a corresponding supporting surface of the dome portion or support plate and air circulation passages can be formed as recesses in the end surface of the extension and/or the supporting surface, from which recessed channels formed radially between the extension and the dome part lead to the outside.

A suspension or standing device can be arranged on the back cover, preferably formed on the back cover.

In order that no moisture can condense between the dial and the support plate, the dial is arranged at a predetermined distance from the support plate so that a stream of air can also flow between these two structural parts. In this connection the dial may also preferably have its radial outer region resting against spacers. In order to interfere as little as possible with the flow of air between the dial and the support plate, the resting surfaces of the spacers may have a small cross section. The spacers can be produced in a simple manner by forming them on the dome portion and/or on the support plate.

In the region of the radially extending edge of the dial, air circulation openings can be arranged to communicate with the inner spaces of the case on both sides of the dial.

Preferably the air circulation openings are axially directed recesses arranged in the inner wall of the dome portion. In this manner an exchange of air can also take place between the spaces of the case on both sides of the dial.

The cover glass can be adapted to be inserted into the observer-side opening of the dome portion, the dome portion being preferably provided in the region of its observer-side opening with radially inward protruding extensions which can be uniformly distributed on the periphery of the inner wall of the case. In this manner the peripheral surface of the cover glass does not abut the inner wall of the dome case but is held spaced from said inner wall by the extensions. Also, in this manner the air circulation passages are provided between the cover glass and the dome portion and communicates with the inside region of the cover glass and the outside.

Preferably pairs of axially extending extensions which are spaced and parallel from each other are arranged diametrically opposite each other. If the cover glass has radially protruding projections which extend into spaces between the parallel extensions, then the extensions at the same time form guides for the installation of the cover glass in the correct position.

The radial length of the projections can be greater than the radial length of the extensions and the projections can be adapted to engage, in the installed position of the cover glass, within recesses which are formed between pairs of extensions in the inner wall of the dome portion. In this manner a simple securing of the cover glass in its installed position is assured.

The dial may also have a radially protruding extension which extends within a recess in the inner wall of the dome portion. The recess preferably extends axially up to the mouth of the observer-side openings. In this manner the dial is secured against twisting and is always in a correct position. The recess can, in this connection, be formed between a pair of the extensions.

If the cover glass has projections which are directed axially into the inside of the case, such cover glass can, upon assembly, be pushed into the dome portion until the projections rest against the dial. The cover glass, in addition to simultaneously holding the dial in its installed position, is thereby held at a predetermined distance from the dial so that air circulation openings are formed between these two structural parts. The projections are preferably formed opposite the spacers against which the dial rests.

In order to conceal from the observer the axially directed holes of the air circulation openings formed between the cover glass and the dome portion the region of the cover glass facing away from the dome portion can be developed with an edge of larger radial extent than the opening of the dome portion at the observer-side. In this connection in order to form openings for the air circulation, the edge is preferably arranged at a predetermined distance from the observer-side face of the dome part. This distancing is preferably achieved by directing the projections toward the inside of the case, which projections are arranged over a suitable length on the cover glass.

The case can be easily manufactured with the dome portion and the support plate being formed as a single part. The dome portion and/or the back cover and/or the cover glass and/or the support plate may be injection molded.

With the above and other objects and advantages in view, the present invention will become more clearly understood in connection with the detailed description of a preferred embodiment, when considered with the accompanying drawings, of which:

Figure 1:
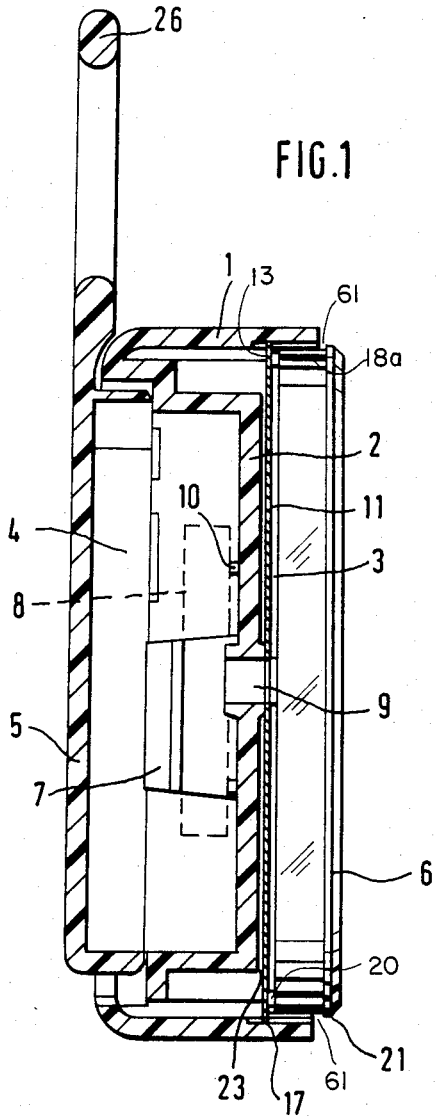
FIG. 1 is a cross section through a case incorporating one embodiment of the invention.
Figure 2:
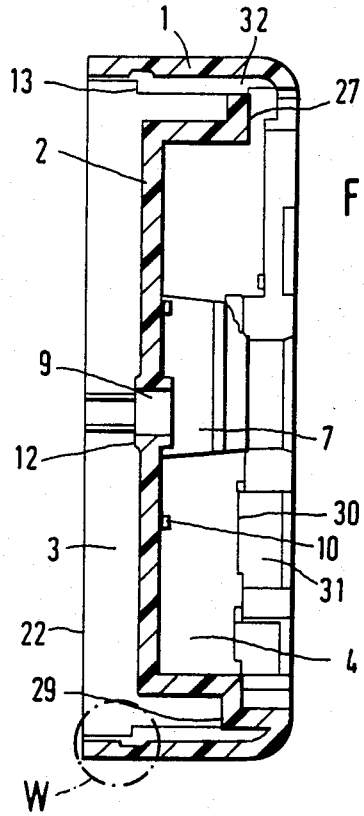
FIG. 2 is a cross section through the dome portion of FIG. 1.
Figure 3:
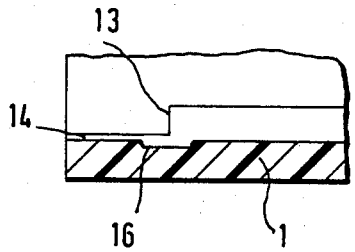
FIG. 3 is an enlarged fragmentary view of the detail W of FIG. 2.
Figure 7:
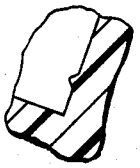
FIG. 7 is a sectional view taken along the line IV—IV of FIG. 4.

The case shown in the figures of the drawings consists of a cylindrical dome portion 1 on which is formed a support plate 2 that divides the case into a front inner space 3 and a rear inner space 4.

The rear opening of the dome portion 1 is closed by a back cover 5 while an observer-side opening 22 is closed by a cover glass 6.

Holding clamps 7 in which the clock movement 8 can be clipped are provided on the support plate 2.

The staff (not shown) of the hands of the clock movement 8 which extends to the observer side of the support plate 2 is passed through a central borehole 9 in the support plate 2.

For good rear ventilation the clock movement 8 is not arranged directly on the support plate 2, but rather on projections 10 formed on the support plate 2.

On the observer side a dial 11 is arranged at a predetermined distance from the support plate 2. This dial 11 lies centrally on an annular extension 12 of the support plate 2 which surrounds the mouth of the borehole 9 and, at the region of its radial edge, against spacers 13 formed on the dome part 1. The dial 11 is in this manner held at the predetermined distance from the support plate 2 and divides the case space between the support plate 2 and an interior face 6*a* of the cover glass into two case spaces 23 and 3 respectively.

The spacers 13 are of relatively small cross section and are formed as axial plates extending in pairs spaced and parallel to each other. Each two of the four pairs of plates are diametrically opposite each other.

Extensions 14 continue from the with a diameter corresponding approximately to the diameter of the dial 11 up to the observer-side opening 22 of the dome portion 1. These extensions 14 extend radially inward from the inner wall of the dome portion 1.

Figure 5:
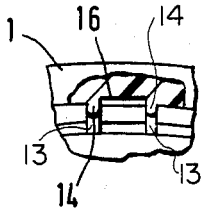
FIG. 5 is an enlarged fragmentary view of the detail X of FIG. 4.
Figure 4:
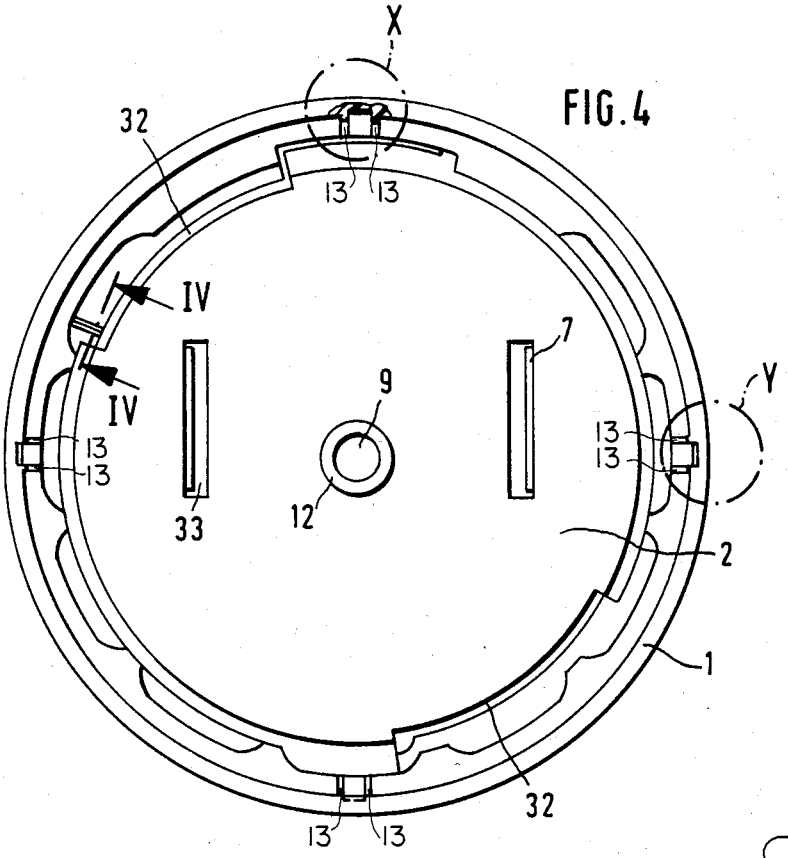
FIG. 4 is an observer-side view of the dome portion of FIG. 1.
Figure 6:
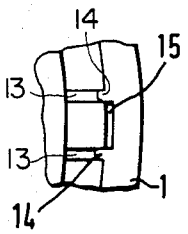
FIG. 6 is an enlarged fragmentary view of the detail Y of FIG. 4.
Figure 8:
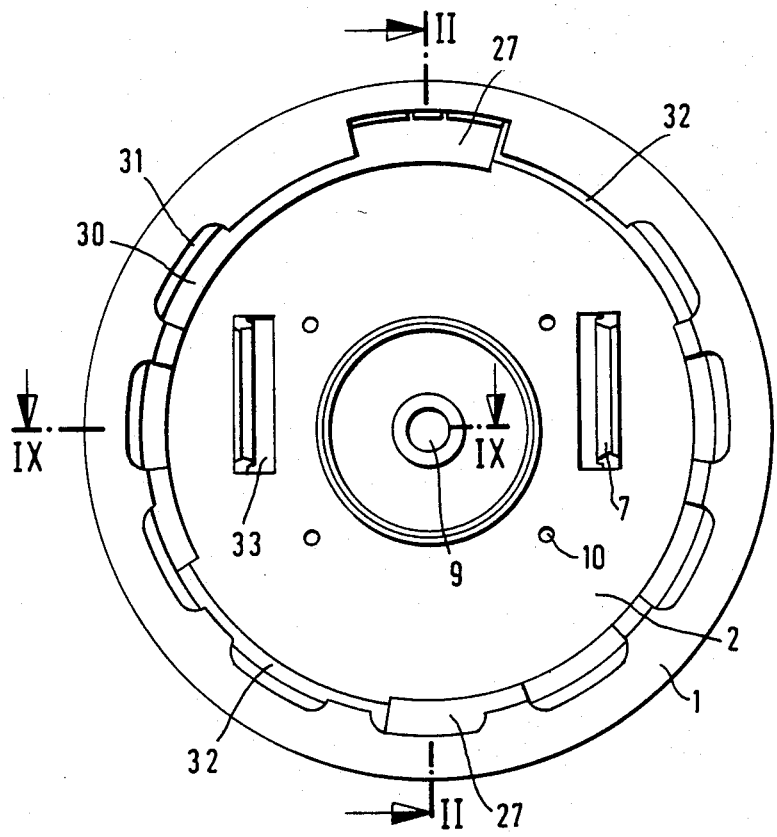
FIG. 8 is a rear view of the dome portion of FIG. 1.
Figure 12:
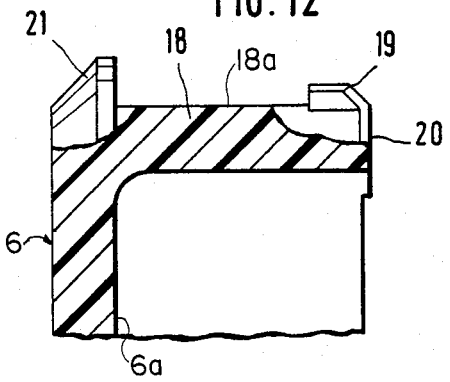
FIG. 12 is an enlarged fragmentary cross section of the detail Z of FIG. 11.
Figure 9:
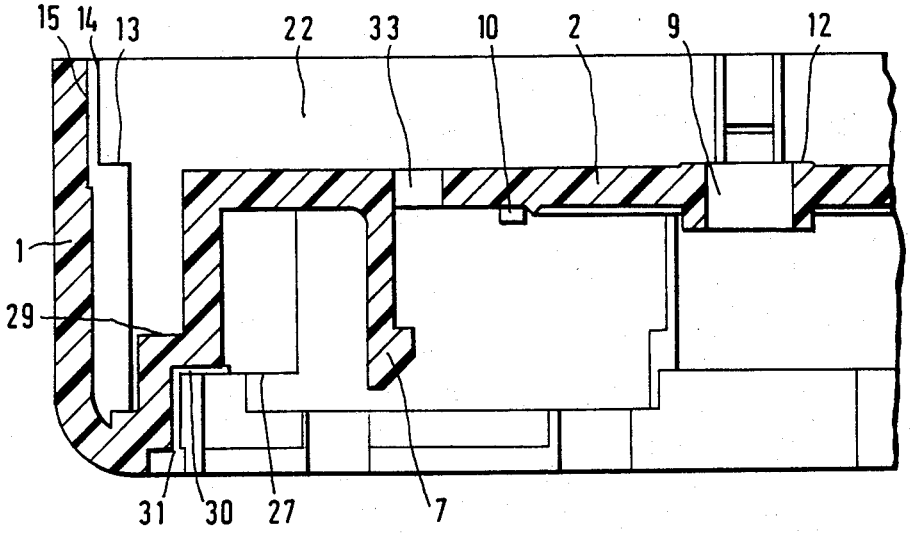
FIG. 9 is an enlarged partial section through the dome portion of FIG. 1.
Figure 10:
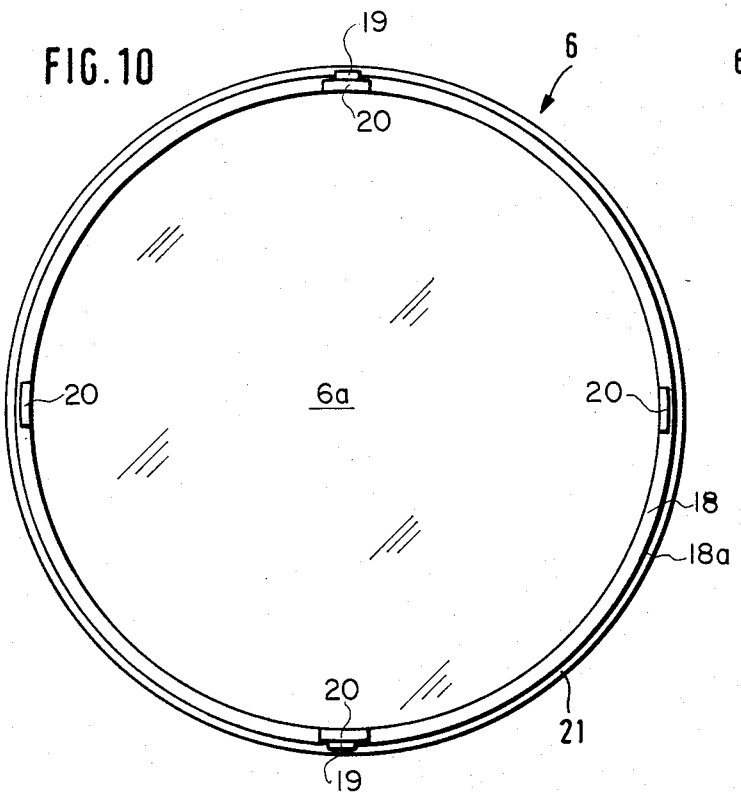
FIG. 10 is a rear view of the cover glass of FIG. 1.
Figure 11:
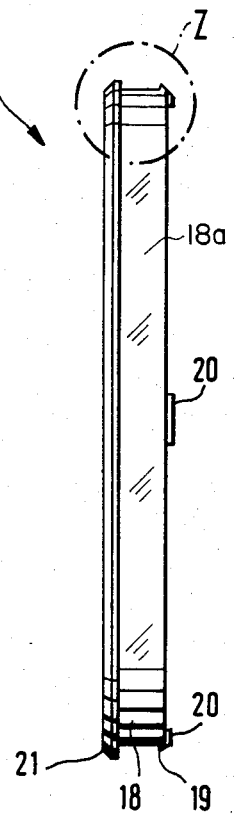
FIG. 11 is a side view of the cover glass of FIG. 10.
Figure 13:
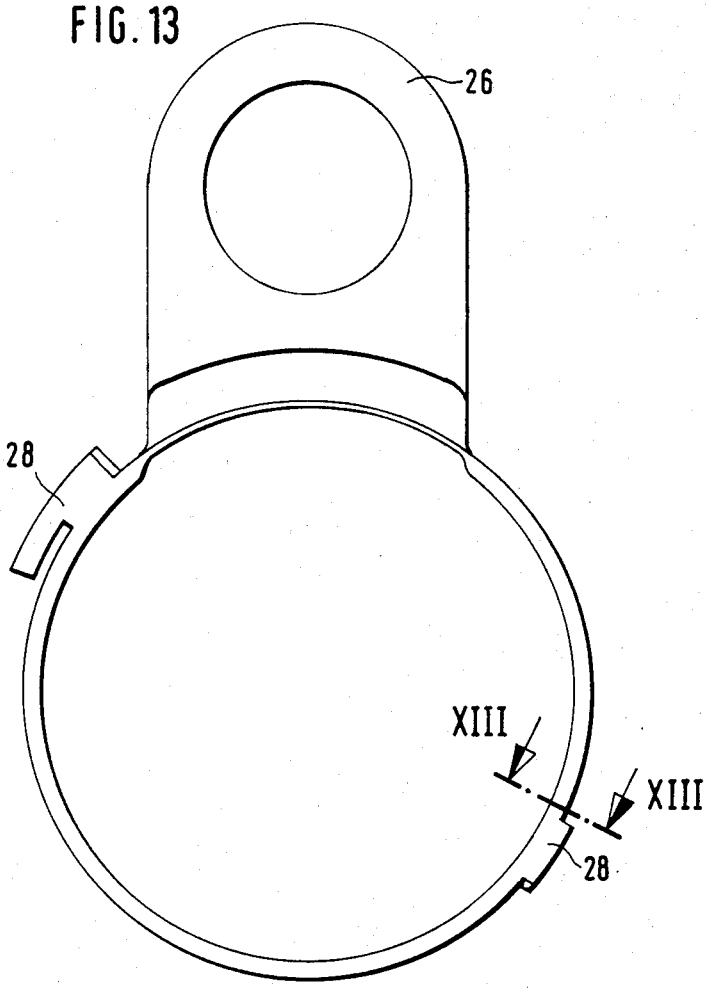
FIG. 13 is a front view of the back cover of FIG. 1.
Figure 14:
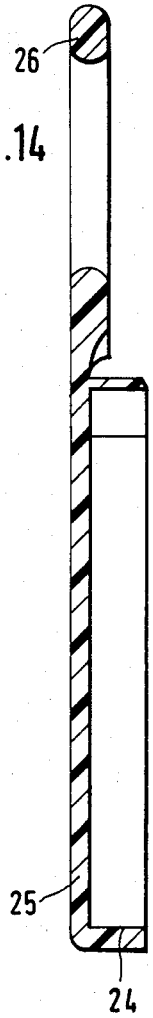
FIG. 14 is a side sectional of the back cover of FIG. 13.
Figure 15:
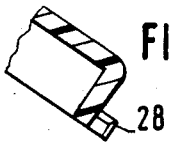
FIG. 15 is a sectional view taken along the line XIII—XIII of FIG. 13.
Figure 17:
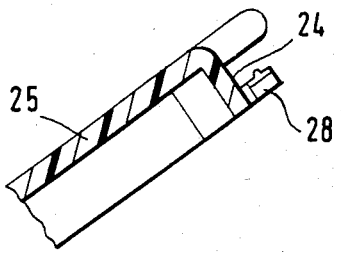
FIG. 17 is an enlarged sectional view taken along the line XVI—XVI of FIG. 16.
Figure 16:
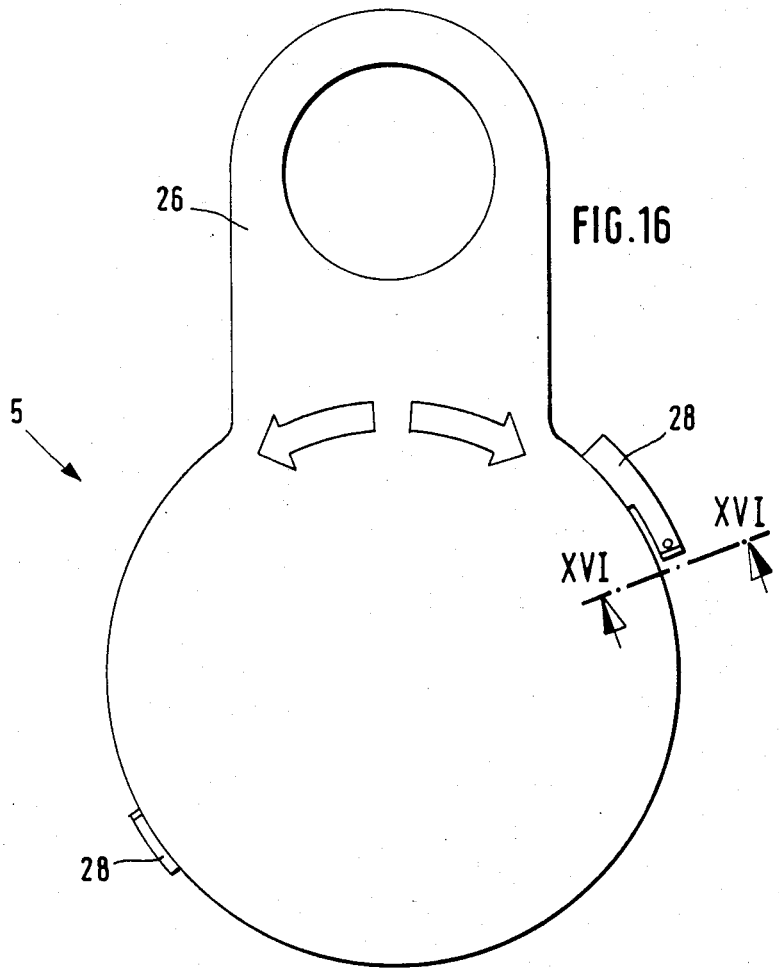
FIG. 16 is a rear view of the back cover of FIG. 13.

Recesses are developed on the inner wall of the dome portion 1 between all of the extensions 14. Recesses 15 are between the adjacent extensions of two of the diametrically opposite pairs of adjacent extensions (the horizontal adjacent extensions 14 in FIGS. 4 and 6) extending up to the mouth of the observer-side opening 22 while the two other recesses 16 terminate before said mouth and are formed in the inner wall of the dome portion 1 between the extensions of the other two diametrically opposite pairs of extensions (the vertical adjacent extensions in FIGS. 4 and 5).

Radially outwardly protruding extensions 17 of the dial 11 extend into the recesses 15 and thus serve to prevent the dial 11 from twisting.

A cylindrical part 18 of the cover glass 6 is inserted into the dome portion 1 and is guided between the extensions 14. Two radially protruding projections 19 of the cover glass 6 engage into the recesses 16 in the installed position of the cover glass. The cover glass 6 rests against the dial 11 via axially protruding projections 20. In this manner the pushing of the cover glass 6 into the dome portion 1 is limited such that an edge 21 of the cover glass 6 is of larger radial extent than the opening 22 of the dome portion 1 does not rest against the end side of the dome portion 1. Thus air circulation passages or openings 61 which are not readily visible to the observer are formed behind the edge 21 and lead between the dome portion 1 and the cylindrical part 18 of the cover glass 6 to the inner space 3 of the case.

The recesses 15 and 16, which simultaneously in cooperation with the outer peripheral surface 18*a* of the cover glass form additional air circulation passages communicating with the outside, connect the inner space 23 or the space 3 of the case, the case inner space 23 being located between the support plate 2 and the dial 11.

The back cover 5 consists of a cylindrical cup-shaped extension 24 which extends into the inner space 4 and is open towards this inner space 4.

The bottom 25 of the cup-shaped extension 24 protrudes axially from the dome portion 1 and is formed with a radially protruding suspension device 26.

The annular end surface of the extension 24 at the mouth side of the dome portion rests against a corresponding support surface 27 formed on the support plate 8 and has radially protruding lips 28 that engages in bayonet fashion behind corresponding surfaces 29 of the support plate 2. In this manner the back cover 5 can be connected with the support plate 2 and with the dome portion 1. Recesses 30 in the support surface 27 which extend radially into the inner space 4 of the case and axial channels 31 formed in the cylindrical part of the dome portion 1 enclosing the extension 24 which are connected at one end with the recesses 30 and extend outwardly at the other end form air circulation openings for ventilating the inner space 4 of the case. The channels 31 are formed by depressions in the cylindrical inner wall of the dome portion 1.

Openings 32 in the radially outer region of the support plate 2 as well as openings 33 in the region of the holding clamps 7 for the clock movement 8 form air circulation openings between the case inner spaces 4 and 23.

Since all the inner spaces 3, 4 and 23 of the case are interconnected and the inner space 3 on the observer side and the inner space 4 on the rear side have openings, a flow of air from the front side through the entire case towards the rear side is obtainable. Thus there is a continuous circulation of air through the case which prevents precipitation or condensation of moisture in the case or immediately removes it.

We claim:

1. A case for a clock for moist rooms, comprising members comprising a hollow cylindrical dome portion and a transparent cover means, said members have peripheral surfaces, at least portions of said peripheral surfaces of said transparent cover means and said dome portion are spaced from each other defining air circulation passages therebetween, said hollow cylindrical dome portion having an observer-side opening and a rear side, and said transparent cover means for substantially closing the observer-side opening of the dome portion, said transparent cover means has an interior face and an exterior face, a back cover substantially closing the rear side of the dome portion, a support plate provided in the dome portion, said support plate dividing the case including the dome portion, said back cover and said transparent cover means into a plurality of inner case spaces, and said support plate on a side thereof facing away from said cover means being adapted to support a clock movement, said air circulation passages being uniformly distributed at said peripheral surfaces adjacent said interior face of said cover means and communicating with the outside, one of the inner case spaces is between the interior face of said transparent cover means and the other side of said support plate which faces said cover means, and said air circulation passages communicate the outside with said one inner case space for enabling a stream of air to flow through said air circulation passages and to pass along said interior face of said transparent cover means, said one inner case space is adapted to house a dial for the clock movement.

2. The case as set forth in claim 1, further comprising said clock movement supported by said support plate, said dial carried on said other side of said support plate facing the cover means.

3. The case as set forth in claim 1, wherein additional air circulation passages are formed in the back cover for communicating the outside with rear of said inner case spaces, said rear inner case space communicates with said one inner case space.

4. The case as set forth in claim 1, wherein the air circulation passages are formed in the dome portion in cooperation with the transparent cover means.

5. The case as set forth in claim 1, wherein the air circulation passages are distributed peripherally around said cover means.

6. The case as set forth in claim 1, wherein said air circulation passages are formed between said transparent cover means and said dome portion.

7. The case as set forth in claim 1, wherein additional air circulation passages are formed between the back cover and the dome portion for communicating the outside with rear of said inner case spaces, said rear inner case space communicates with said one inner case space.

8. The case as set forth in claim 2, further comprising means for spacing the dial a predetermined distance from the support plate, said spacing means includes spacers formed in the dome portion, and the dial rests against said spacers, said inner case spaces which are divided by the support plate include a front inner space constituting said one inner case space at the observer side, a rear inner space at the rear side of the dome portion and an intermediate space constituting a portion of said one inner case space defined between the support plate and the dial, the latter dividing the front inner space, and said inner case spaces are in communication with each other.

9. The case as set forth in claim 8, wherein said dial has a radial peripheral region and additional air circulation passages connect said one inner case space and the intermediate space and are arranged at the radial region of the dial.

10. The case as set forth in claim 6, wherein the transparent cover means is inserted into the observer-side opening of the dome portion.

11. The case as set forth in claim 1, wherein said clock case has a central axis and the transparent cover means has projections which are directed axially into the interior of the case, said clock movement supported by said support plate, means for spacing said dial a predetermined distance from the support plate comprising spacers formed on the dome portion, said dial resting against said spacers, and said projections abut said dial and are formed on a rear of said transparent cover means substantially opposite the spacers, said projections space said rear of said transparent cover means from said dial and spaces therebetween constituting a portion of said air circulation passages communicating with said one inner case space.

12. The case as set forth in claim 1, wherein the transparent cover means has a region, facing away from the dome portion, formed with an edge of larger radial extent than the observer-side opening of the dome portion, said edge is spaced a predetermined distance from said dome portion and the observer-side opening of the dome portion, said air circulation passages communicate with the outside between said edge and said dome portion.

13. The case as set forth in claim 1, wherein
the dome portion and the support plate are integrally formed in one-piece.

14. The case as set forth in claim 10, wherein
the peripheral surface of said dome portion is defined by an inwardly facing inner wall forming said observer-side opening,
said inwardly facing inner wall is formed with inwardly projecting extensions, and
said cover means has an outwardly facing outer peripheral surface engaging said extensions, spaced from said inwardly facing inner wall of said dome portion and cooperating with said extensions and said inner wall to define said air circulation passages therebetween.

15. The case as set forth in claim 14, further comprising
spacers formed on said inner wall of said dome portion, each of said spacers extending axially to an abutment surface thereof spaced from a front end of said observer-side opening and from said support plate,
adjacent two of said inwardly projecting extensions respectively form pairs of said extensions axially extending from said spacers toward the front end of said observer-side opening,
said inwardly facing inner wall is formed with axially extending recesses between said adjacent two extensions of selected of said pairs of extensions and extending axially spaced from the front end of said observer-side opening,
said dial engages said abutment surface of said spacers and has a peripheral edge at least at portions thereof spaced radially inwardly from said inwardly facing inner wall and from axial ends of said recesses, said recesses constitute a portion of said air circulation passages.

16. The case as set forth in claim 14, wherein
said extensions extend axially parallel with respect to a central axis of said dome portion, spaced parallel to each other, and form pairs of adjacent said extensions, said pairs of extensions being arranged diametrically opposite each other.

17. The case as set forth in claim 14, wherein
said transparent cover means has radially protruding projections which extend between adjacent of the extensions of at least some of said pairs of said extensions.

18. The case as set forth in claim 17, wherein
recesses are formed in the peripheral surface of said dome portion between said adjacent extensions of the corresponding said pair, and the projections of the transparent cover means extend into the recesses between said extensions.

19. The case as set forth in claim 16, further comprising
said clock movement supported by said support plate, recesses are formed in the peripheral surface of the dome portion and the dial has at least one radial protrusion which extends into a corresponding of said recesses, each of said recesses being formed between a pair of adjacent said extensions and extending axially up to a front end of said observer-side opening.

* * * * *

UNITED STATES PATENT AND TRADEMARK OFFICE

CERTIFICATE OF CORRECTION

PATENT NO. : 4,505,598

DATED : March 19, 1985

INVENTOR(S) : Dieter Wolf, et al

It is certified that error appears in the above-identified patent and that said Letters Patent is hereby corrected as shown below:

"dome" should read --casing-- (all occurrences)

in the abstract: Lines 2 and 5;

in the specification: Column 1, Lines 6, 9, 36, 47, 49, 59, 61, 62, 66, 67; Column 2, Lines 1, 5, 18, 24, 29, 35, 38, 52, 56, 63; Column 3, Lines 5, 6, 8, 12, 16, 18, 29, 33, 41, 43, 57, 60; Column 4, Lines 9, 20, 22, 23, 30, 38, 44, 46, 47, 50, 63, 66; Column 5, Lines 4, 7, 12;

in the claims: Column 5, Lines 28, 32, 35, 38, 42, 43, 44; Column 6, Lines 6, 14, 17, 25, 30, 43, 51, 62, 64, 65, 66, 68.

Signed and Sealed this

Sixteenth Day of December, 1986

*Attest:*

DONALD J. QUIGG

*Attesting Officer* *Commissioner of Patents and Trademarks*